US008361382B2

(12) United States Patent
Honjo et al.

(10) Patent No.: US 8,361,382 B2
(45) Date of Patent: Jan. 29, 2013

(54) HIGH-STRENGTH PEARLITIC STEEL RAIL HAVING EXCELLENT DELAYED FRACTURE PROPERTIES

(75) Inventors: Minoru Honjo, Kurashiki (JP); Tatsumi Kimura, Kurashiki (JP); Shinichi Suzuki, Kawasaki (JP); Nobuo Shikanai, Kurashiki (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/299,678

(22) Filed: Nov. 18, 2011

(65) Prior Publication Data

US 2012/0076685 A1 Mar. 29, 2012

Related U.S. Application Data

(62) Division of application No. 12/225,104, filed as application No. PCT/JP2007/056128 on Mar. 16, 2007.

(30) Foreign Application Priority Data

Mar. 16, 2006 (JP) ..... 2006-072720
Jul. 27, 2006 (JP) ..... 2006-205175

(51) Int. Cl.
*C22C 38/60* (2006.01)
*C22C 38/18* (2006.01)
*C22C 38/12* (2006.01)

(52) U.S. Cl. ..... 420/84; 420/104; 420/110

(58) Field of Classification Search ..... 420/84, 420/104, 110
See application file for complete search history.

(56) References Cited

U.S. PATENT DOCUMENTS 5,658,400 A 8/1997 Uchino et al.
2005/0265886 A1 12/2005 Hayaishi et al.

FOREIGN PATENT DOCUMENTS

| | | | |
|---|---|---|---|
| JP | 57-198216 | A | 12/1982 |
| JP | 61-143555 | A | 7/1986 |
| JP | 62-161917 | A | 7/1987 |
| JP | 02-267241 | A | 11/1990 |
| JP | 05-287450 | A | 11/1993 |
| JP | 06-279850 | A | 10/1994 |
| JP | 06-279928 | A | 10/1994 |
| JP | 06-279929 | A | 10/1994 |
| JP | 07-018326 | A | 1/1995 |
| JP | 08-109438 | A | 4/1996 |
| JP | 09-206804 | A | 8/1997 |
| JP | 2000-328190 | A | 11/2000 |
| JP | 2000-345296 | A | 12/2000 |

(Continued)

OTHER PUBLICATIONS

International Search Report dated Jun. 26, 2007 for PCT/JP2007/056128.

(Continued)

*Primary Examiner* — Stuart Hendrickson
*Assistant Examiner* — Alexander Polyansky
(74) *Attorney, Agent, or Firm* — Holtz Holtz Goodman & Chick PC

(57) ABSTRACT

A steel rail including a composition of, in mass percent, C of 0.6% to 1.0%, Si of 0.1% to 1.5%, Mn of 0.4% to 2.0%, P of 0.035% or less, S of 0.010% or less, Ca of 0.0010% to 0.010%, and the remainder being Fe and inevitable impurities, wherein the tensile strength is 1200 MPa or more, and the size of a long side of a C type inclusion is 50 μm or less in at least a cross-section in a longitudinal direction of a rail head, and the number of Ca type inclusions, each having a size of a long side of 1 μm to 50 μm, is 0.2 to 10 per observed area of 1 $mm^2$ in the cross-section in the longitudinal direction of the rail head.

4 Claims, 6 Drawing Sheets

FOREIGN PATENT DOCUMENTS

| | | | |
|---|---|---|---|
| JP | 2001-181737 | A | 7/2001 |
| JP | 2002-069583 | A | 3/2002 |
| JP | 2002-327233 | A | 11/2002 |
| JP | 2002-363702 | A | 12/2002 |
| JP | 2003-105499 | A | 4/2003 |
| JP | 2003-129177 | A | 5/2003 |
| JP | 2003-129181 | A | 5/2003 |
| JP | 2006-057127 | A | 3/2006 |

OTHER PUBLICATIONS

Canadian Office Action dated Dec. 30, 2010 for Canadian Application No. 2,645,858.

Canadian Office Action dated Sep. 14, 2011 or Canadian application No. 2,645,858.

HIGH-STRENGTH PEARLITIC STEEL RAIL HAVING EXCELLENT DELAYED FRACTURE PROPERTIES

CROSS-REFERENCE TO RELATED APPLICATIONS

This application is a divisional application of application Ser. No. 12/225,104 filed Sep. 15, 2008, which is the U.S. national phase application under 35 USC 371 of International application PCT/JP2007/056128 filed Mar. 16, 2007. The entire contents of each of application Ser. No. 12/225,104 and International application PCT/JP2007/056128 are hereby incorporated by reference herein.

TECHNICAL FIELD

The present invention relates to a high-strength pearlitic steel rail having a tensile strength of 1200 MPa or more, which is excellent in delayed fracture properties.

BACKGROUND ART

A high-axle load railway such as a mining railway mainly carrying mineral ore is large in carrying capacity of a train or a freight car. In such a railway, a load applied to an axle of a freight car is extremely large compared with a passenger car, in addition, use environment of a rail is more severe. For a rail used in such an environment, steel having a pearlitic structure has been mainly used from a point of significant concern of wear resistance. However, recently, carrying capacity of a freight car is further increased for efficient railway transportation, so that use environment of a rail becomes more severe, and consequently further improvement in wear resistance or rolling contact fatigue (RCF) resistance is required for the rail.

To meet such requirement, from the point of significant concern of wear resistance or RCF resistance, a rail is aimed to be increased in strength, and a high-strength pearlitic steel rail having a tensile strength of 120 kg/mm$^2$ (1200 MPa) or more is proposed as shown in Japanese Unexamined Patent Application Publication JP-A-7-18326. However, it is known that possibility of delayed fracture is increased in high-strength steel having a tensile strength of 1200 MPa or more. While high strength is obtained by the technique shown in the JP-A-7-18326, adequate delayed fracture properties are not obtained by the technique.

As a technique for improving delayed fracture properties of high-strength pearlitic steel, for example, Japanese Patent No. 3,648,192 and JP-A-5-287450 disclose a technique that high-strength pearlitic steel is subjected to high wire drawing process so as to improve delayed fracture properties. However, when the technique is applied to the rail, a problem occurs, that is, the high wire drawing process causes increase in manufacturing cost.

As a method of improving delayed fracture properties other than the above, it is known that a figure and volume of A type inclusions are effectively controlled. JP-A-2000-328190, JP-A-6-279928, Japanese Patent No. 3,323,272, and JP-A-6-279929 disclose such control of the figure and volume of A type inclusions in rail steel respectively. However, each of JP-A-2000-328190, JP-A-6-279928, Japanese Patent No. 3,323,272, and JP-A-6-279929 aims to improve toughness and ductility of a rail, and does not always provide excellent delayed fracture properties. For example, JP-A-6-279928 discloses a method where size of an A type inclusion is controlled to be 0.1 to 20 μm, and the number of A type inclusions is controlled to be 25 to 11,000 per square millimeters, so that toughness and ductility of a rail are improved. However, excellent delayed fracture properties are not always given by the method.

On the other hand, Japanese Patent No. 3,513,427 or Japanese Patent No. 3,631,712 discloses that Ca is added for improving toughness and ductility of a material for a rail. For example, Japanese Patent No. 3,513,427 discloses a method where Ca of 0.0010 to 0.0150% is added to produce a sulfide in a form of CaS, and the CaS is used to finely disperse MnS, so that a Mn dilute zone is formed around MnS so as to contribute to occurrence of pearlite transformation, and block size of such pearlite is refined, thereby toughness and ductility of a rail are improved.

However, while the methods are useful to improve toughness and ductility, they do not take delayed fracture properties into consideration. Moreover, when the added amount of Ca is increased, since rough and large C-type inclusions are generated in steel, RCF resistance is reduced. Here, the A type inclusion and the C type inclusion are those defined in Appendix 1 of JIS (Japanese Industrial Standards)

DISCLOSURE OF THE INVENTION

The invention was made in the light of such a circumstance, and an object of the invention is to provide a high-strength, pearlitic steel rail, which is inexpensive, and has a tensile strength of 1200 MPa or more, in addition, has excellent delayed fracture properties.

To solve the above problem, the invention provides the following (1) to (10).

(1) A high-strength pearlitic steel rail having excellent delayed fracture properties, characterized by containing, in mass percent, C of 0.6 to 1.0%, Si of 0.1 to 1.5%, Mn of 0.4 to 2.0%, P of 0.035% or less, S of 0.0005 to 0.010%, and the remainder being Fe and inevitable impurities, wherein tensile strength is 1200 MPa or more, and size of a long side of an A type inclusion is 250 μm or less in at least a cross-section in a longitudinal direction of a rail head, and the number of A type inclusions, each having a size of a long side of 1 μm or more and 250 μm or less, is less than 25 per observed area of 1 mm$^2$ in the cross-section in the longitudinal direction of the rail head.

(2) The high-strength pearlitic steel rail having excellent delayed fracture properties, further containing Ca of 0.001 to 0.010% in mass percent in a composition in the (1), wherein size of a long side of a C type inclusion is 50 μm or less in at least a rail head, and the number of C type inclusions having a size of a long side of 1 μm or more and 50 μm or less is 0.2 or more and 10 or less per observed area of 1 mm$^2$ in a cross-section in a longitudinal direction of the rail head.

(3) The high-strength pearlitic steel rail having excellent delayed fracture properties, wherein O is controlled to be 0.004% or less in a composition of the (2).

(4) The high-strength pearlitic steel rail having excellent delayed fracture properties, wherein ACR defined by the following expression (1) is 0.05 or more and 1.20 or less in the composition in the (2) or (3);

$$ACR = \frac{1}{1.25}\frac{[\%\ Ca] - \{0.18 + 130[\%\ Ca]\}[\%\ O]}{[\%\ S]}, \quad (1)$$

wherein

ACR shows Atomic Concentration Ratio,

[% Ca] shows Ca content (mass percent),

[% O] shows O content (mass percent), and

[% S] shows S content (mass percent).

(5) The high-strength pearlitic steel rail having excellent delayed fracture properties according to one of the (1) to (4), wherein the amount of hydrogen is 2 ppm by mass or less.

(6) The high-strength pearlitic steel rail having excellent delayed fracture properties according to one of the (1) to (5), further containing, in mass percent, one or at least two selected from V of 0.5% or less, Cr of 1.5% or less, Cu of 1.0% or less, Ni of 1.0% or less, Nb of 0.05% or less, Mo of 1.0% or less, and W of 1.0% or less.

(7) A high-strength pearlitic steel rail having excellent delayed fracture properties, containing, in mass percent, C of 0.6 to 1.0%, Si of 0.2 to 1.2%, Mn of 0.4 to 1.5%, P of 0.035% or less, S of 0.0005 to 0.010%, and the remainder being Fe and inevitable impurities, wherein tensile strength is 1200 MPa or more, and size of a long side of an A type inclusion is 250 μm or less in at least a cross-section in a longitudinal direction of a rail head, and the number of A type inclusions, each having a size of 1 μm or more and 250 μm or less, is less than 25 per observed area of 1 $mm^2$ in the cross-section in the longitudinal direction of the rail head.

(8) The high-strength pearlitic steel rail having excellent delayed fracture properties according to the (7), further containing, in mass percent, one or at least two selected from V of 0.5% or less, Cr of 1.5% or less, Cu of 1% or less, Ni of 1% or less, Nb of 0.05% or less, Mo of 0.5% or less, and W of 1% or less.

(9) A high-strength pearlitic steel rail having excellent delayed fracture properties, having a composition of, in mass percent, C of 0.6% or more and 1.0% or less, Si of 0.1% or more and 1.5% or less, Mn of 0.4% or more and 2.0% or less, P of 0.035% or less, S of 0.100% or less, Ca of 0.0010% or more and 0.010% or less, and the remainder substantially being Fe and inevitable impurities, wherein tensile strength is 1200 MPa or more, and size of a long side of a C type inclusion is 50 μm or less in at least a rail head, and the number of C type inclusions, each having a size of a long side of 1 μm or more and 50 μm or less, is 0.2 or m and 10 or less per observed area of 1 $mm^2$ in a cross-section in a longitudinal direction of the rail head.

(10) The high-strength pearlitic steel rail having excellent delayed fracture properties according to the (9), O is limited to be 0.002% or less.

BEST MODE FOR CARRYING OUT THE INVENTION

Figure 1:
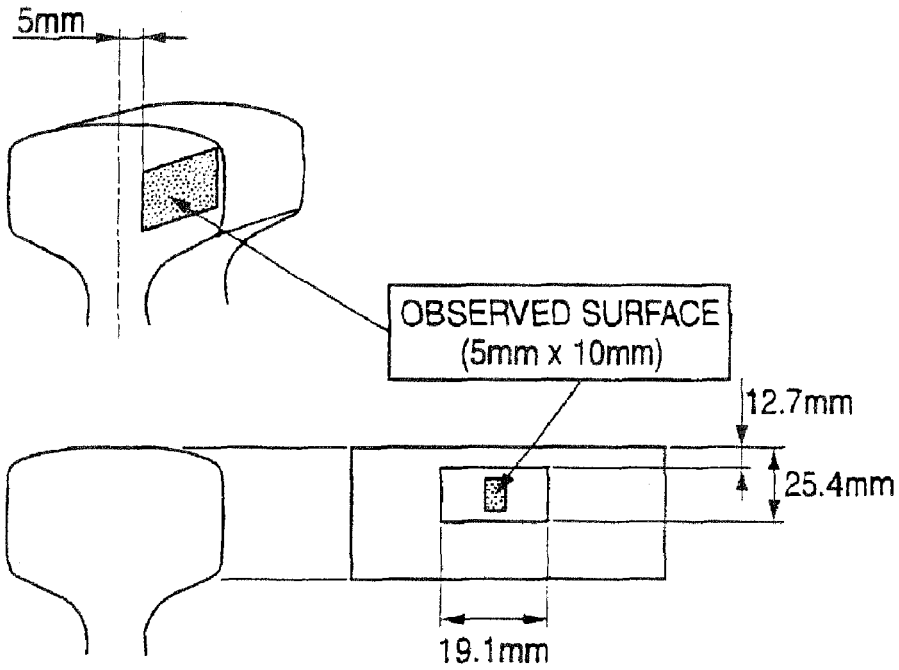
FIG. 1 shows a diagram showing a collection position of a sample used for measuring dimensions of an inclusion, and measuring the number of inclusions.

To solve the problems described in the background art, the inventors optimized a composition, in addition, investigated rails in which an A type inclusion was varied in figure and quantity, and the amount of hydrogen in steel was varied, as a result, they found that when size of a long side of the A type inclusion in a rail was less than 1 μm, since the A type inclusion had an approximately spherical shape, the A type inclusion did not have a significant effect on delayed fracture properties, but when the size was 1 μm or more, since the inclusion was elongated, the effect on delayed fracture properties was increased, and therefore the number of A type inclusions, each having a size of a long side of 1 μm or more, was controlled, thereby delayed fracture properties were improved compared with hypoeutectoid, eutectoid, and hypereutectoid pearlitic steel rails in the past. Moreover, they found that the amount of hydrogen in steel to be a cause of delayed fracture properties was limited, thereby the delayed fracture properties were further improved. In the invention, each of components of a rail is specified to be in a particular range based on such findings, in addition, maximum size of a long side of A type inclusions is controlled to be 250 μm or less in a cross-section in a longitudinal direction of a rail head, and the number of A type inclusions, each having a size of 1 μm to 250 μm, is controlled to be less than 25 per observed area of 1 $mm^2$ in the cross section. Thus, a pearlitic steel rail can be achieved, which has a tensile strength of 1200 MPa or more, in addition, has excellent delayed fracture properties. In addition to this, the amount of hydrogen in steel is adjusted to be 2 ppm or less, thereby delayed fracture properties are further improved.

According to the invention, a high-strength pearlitic steel rail can be provided, in which tensile strength is 1200 MPa or more, and size of a long side of each A type inclusion in steel and the number of the A type inclusions are controlled, thereby delayed fracture properties can be improved without needing the high wire drawing process that requires high cost, and therefore cost is low, in addition, delayed fracture properties are excellent.

Moreover, in the rail of the invention, a composition is optimized, and particularly, size of a long side of each C type inclusion in a rail, and the number of C type inclusions, each having the specified size of a long side, are controlled, thereby delayed fracture properties are improved compared with a rail including hvpoeutectoid, eutectoid, and hypereutectoid pearlite structures.

According to the invention, a rail can be provided, which has excellent properties contributing to prolongation of rail life of a high-axle load railway or prevention of railway accidents, that is, has high strength, and is excellent in delayed fracture properties and RCF resistance, and consequently industrially effective advantages are provided.

Hereinafter, the invention is specifically described.

First, a chemical composition is described.

A rail of the invention contains, in mass percent, C of 0.6 to 1.0%, Si of 0.1 to 1.5%, Mn of 0.4 to 2.0%, P of 0.035% or less, S of 0.0005 to 0.010%, and the remainder is Fe and inevitable impurities. The rail further contains one or at least two selected from V of 0.5% or less, Cr of 1.5% or less, Cu of 1% or less, Ni of 1% or less, Nb of 0.05% or less, Mo of 1% or less, and W of 1% or less. Moreover, the amount of hydrogen in steel is preferably 2 ppm or less by mass.

C: 0.6 to 1.0%

C is an essential element for forming cementite in a pearlite structure, and securing rail strength, the rail strength being increased with increase in added amount of C. When the C content is less than 0.6%, high strength is hardly obtained compared with a heat treatment type, pearlitic steel rail in the past. On the other hand, when the C content is more than 1.0%, primary cementite is formed at an austenite grain boundary during transformation after hot rolling, leading to significant reduction in delayed fracture properties. Therefore, the C content is adjusted to be 0.6% to 1.0% More preferably, the C content is 0.6% to 0.9%.

Si: 0.1 to 1.5%

Si is an element to be added as a deoxidizing agent, and Si of 0.1% or more needs to be contained for such deoxidizing. Moreover, since Si has an effect of increasing strength through solid solution hardening caused by solid solution of Si into ferrite in pearlite, Si is actively added. However, when the amount of Si exceeds 1.5%, a large quantity of oxide inclusions are generated due to high bonding force of Si with oxygen, leading to reduction in delayed fracture properties. Therefore, the Si content is adjusted to be 0.1 to 1.5%. Preferably, the Si content is adjusted to be 0.2 to 1.2%. More preferably, the Si content is 0.2 to 0.9%.

Mn: 0.4 to 2.0%

Mn is an element that decreases the pearlite transformation temperature to reduce lamellae spacing of a pearlite structure, thereby contributes to increasing strength and ductility of a rail. However, when the content of Mn is less than 0.4%, an adequate effect is not obtained, and when the content exceeds 2.0%, a martensitic structure of steel is easily formed due to micro segregation, which may induce hardening or embrittlement during heat treatment and during welding, leading to degradation in material. Therefore, the Mn content is adjusted to be 0.4 to 2.0%. More preferably, the Mn content is 0.4 to 1.5%.

P: 0.035% or Less

When P of more than 0.035% is contained, ductility is degraded. Therefore, the P content is adjusted to be 0.035% or less. More preferably, the P content is 0.020% or less.

S: 0.0005 to 0.010%

When the content of S, which exists in steel mainly in a form of A type inclusion, exceeds 0.010%, the quantity of the inclusions is significantly increased, and rough and large inclusions are generated, which induces degradation in delayed fracture properties. On the other hand, when the S content is less than 0.0005%, cost of rail steel is increased. Therefore, the S content is adjusted to be 0.0005 to 0.010%. Preferably, the S content is 0.0005 to 0.008%. More preferably, the S content is 0.0005 to 0.006%.

While the above elements are specified as basic components, the following elements can be further contained.

Ca: 0.0010 to 0.010%

Ca is an important element that controls a figure of a C type inclusion or the number of C type inclusions particularly for improving delayed fracture properties of rail steel. When the content of Ca is less than 0.0010%, the effect of improving delayed fracture properties of rail steel is not obtained. When the content exceeds 0.010%, cleanliness of the rail steel is reduced, causing reduction in RCF resistance of a rail. Therefore, the Ca content is adjusted to be 0.0010 to 0.010%. Preferably, the Ca content is 0.0010 to 0.008%.

O (oxygen): 0.004% or Less

In addition, O (oxygen) is preferably adjusted to be 0.004% or less. O sometimes forms an oxide inclusion, causing reduction in RCF resistance of the rail. That is, when the content of O exceeds 0.004%, the oxide inclusion may become rough and large, leading to reduction in RCF resistance. More preferably, the O content is adjusted to be 0.002% or less.

ACR (Atomic Concentration Ratio): 0.05 to 1.20

ACR on Ca, S and O among the basic components is preferably 0.05 to 1.20, the ACR being defined by the following expression (1);

$$ACR = \frac{1}{1.25}\frac{[\%\ Ca] - \{0.18 + 130[\%\ Ca]\}[\%\ O]}{[\%\ S]}, \quad (1)$$

wherein

[% Ca] shows Ca content (mass percent),

[% O] shows O content (mass percent), and

[% S] shows S content (mass percent).

The ACR is a measure for controlling a figure of the C type inclusion, and when a value of the ACR is less than 0.05, effective control of the figure of the C type inclusion as described later cannot be performed, and consequently delayed fracture properties are degraded. On the other hand, when the value is more than 1.20, the delayed fracture properties are substantially not affected, but a large quantity of C type inclusions are generated, leading to reduction in RCF resistance of rail steel. Consequently, particularly when Ca is added, ACR is preferably adjusted to be 0.05 to 1.20. More preferably, ACR is 1.0 or less.

V: 0.5% or Less

V is precipitated as a carbonitride during and after rolling, and acts as a trap site of hydrogen, so that it improves the delayed fracture properties. Therefore, V is added as needed. To obtain such an effect, the V content is preferably 0.005% or more. However, when V of more than 0.5% is added, a large quantity of rough and large carbonitrides are precipitated, causing degradation in delayed fracture properties. Therefore, when V is added, the added amount is adjusted to be 0.5% or less.

Cr: 1.5% or Less

Cr is an element for further increasing strength through solid solution hardening, and added as needed. To obtain such an effect, the Cr content is preferably 0.2% or more. However, when the content exceeds 1.5%, hardenability is increased, and thus martensite may be formed, leading to reduction in ductility. Therefore, when Cr is added, the content is adjusted to be 1.5% or less.

Cu: 1% or Less

Cu is an element for further increasing strength through solid solution hardening as in the case of Cr, and is added as needed. To obtain such an effect, the Cu content is preferably 0.005% or more. However, when the content exceeds 1%, a Cu-induced crack may occur. Therefore, when Cu is added, the content is adjusted to be 1% or less.

Ni: 1% or Less

Ni is an element for increasing strength without reducing ductility, and added as needed. Moreover, when Ni is added together with Cu, Ni acts to prevent the Cu-induced crack, and therefore when Cu is added, Ni is desirably added together. To obtain such effects, the Ni content is preferably 0.005% or more. However, when the content exceeds 1%, hardenability is increased, and thus martensite may be formed, leading to reduction in ductility. Therefore, when Ni is added, the content of Ni is adjusted to be 1% or less.

Nb: 0.05% or Less

Nb is precipitated as a carbonitride during and after rolling, and acts as a trap site of hydrogen, so that Nb improves delayed fracture properties, and therefore added as needed. To obtain such an effect, the Nb content is preferably 0.005% or more. However, when Nb of more than 0.05% is added, a large quantity of rough and large carbonitrides are precipitated, causing degradation in delayed fracture properties. Therefore, when Nb is added, the content of Nb is adjusted to be 0.05% or less. More preferably, the content is 0.03% or less.

Mo: 1% or less, W: 1% or Less

Mo or W is precipitated as a carbide during and after rolling, and acts as a trap site of hydrogen, so that it improves delayed fracture properties, and may further increase strength through solid solution hardening. Therefore, Mo or W is added as needed. To obtain such an effect, the content of each of Mo and W is preferably 0.005% or more. However, when Mo or W of more than 1% is added, martensite may be formed, leading to reduction in ductility. Therefore, when Mo is added, the content of Mo is adjusted to be 1% or less, and when W is added, the content of W is adjusted to be 1% or less. More preferably, the content of Mo is 0.25% or less, and the content of W is 0.50% or less.

Amount of Hydrogen in Steel: 2 ppm or Less

Hydrogen is an element to be a cause of delayed fracture. When the amount of hydrogen in steel exceeds 2 ppm, a large amount of hydrogen is trapped collected around a boundary of inclusion, consequently delayed fracture easily occurs. Therefore, the amount of hydrogen in steel is preferably limited to be 2 ppm or less.

The remainder is Fe and inevitable impurities. Here, P, N and O or the like are the impurities, wherein an upper limit value of P is allowably 0.035% as described before, an upper limit value of N is allowably 0.005%, and an upper limit value of O is allowably 0.004%. Furthermore, an upper limit value of each of Al and Ti caught up therein as impurities is allowably 0.0010% in the invention. Specifically, each of Al and Ti forms an oxide, and the quantity of inclusions in steel is thus increased, leading to degradation in delayed fracture properties. Moreover, this induces reduction in RCF resistance as a basic property of a rail, therefore the content of each of Al and Ti needs to be controlled to be 0.0010% or less.

Hereinafter, the A type inclusions and the C type inclusions in size and the number, and tensile strength are described, respectively. Here, the A type inclusions and the C type inclusions are those defined in Appendix 1 of JIS G0555.

Tensile Strength: 1200 MPa or More

When tensile strength is less than 1200 MPa, while delayed fracture properties of a rail is excellent, wear resistance or RCF resistance in the same level as that of a conventional pearlitic steel rail is not obtained. Therefore, tensile strength is adjusted to be 1200 MPa or more.

Size of A Type Inclusion: Maximum Size of Long Side of A Yype Inclusion is 250 μm or Less in Cross-section in Longitudinal Direction of Rail Head When size of a long side of the A type inclusion exceeds 250 μm, since a rough and large inclusion is generated in the rail, delayed fracture properties are degraded. Therefore, preferable maximum size of the long side of the A type inclusion in the rail is 250 μm or less in a cross-section in a longitudinal direction of a rail head. Here, meaning of the description that maximum size of the long side of the A type inclusion is limited to be 250 μm or less is that when A type inclusions are observed in a view field of 50 $mm^2$ with a magnification of 500 by an optical microscope so as to measure size of each long side of all the found A type inclusions, the maximum size of the long side is 250 μm or less.

Figure 7:
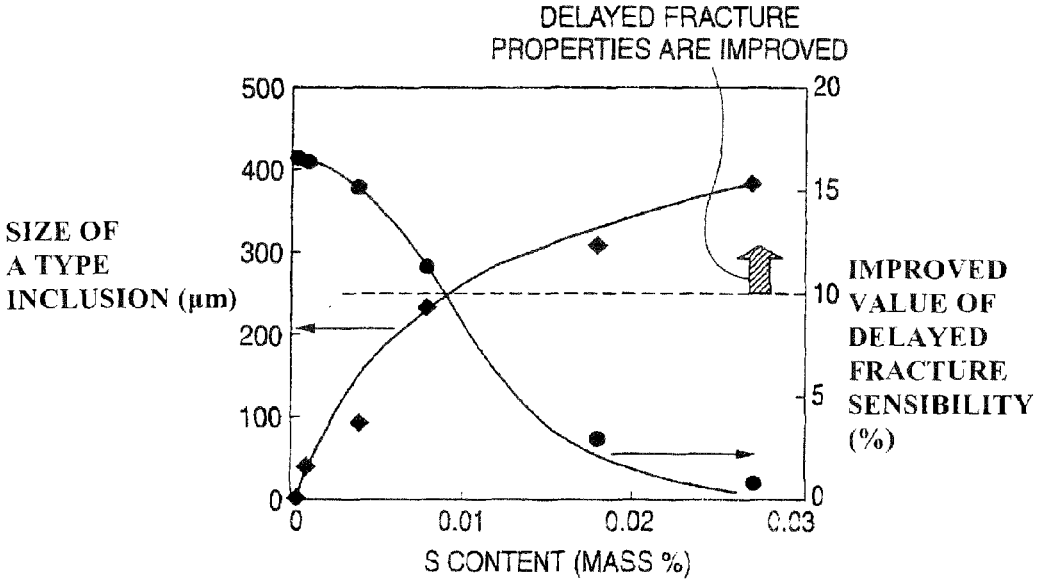
FIG. 7 shows a graph showing an effect of the S content on size of a long side of an A type inclusion and on an improved value of delayed fracture sensibility in the materials of the invention and the comparative materials.

Here, in an example as described later, a relationship between size of a long side of each A type inclusion and each of improved values of delayed fracture sensibility is shown in FIG. 7 in an arranged manner. As shown in the figure, an improved value of delayed fracture sensibility of a rail of 10% or more is obtained in the case that the maximum size of the long side of the A type inclusion is 250 μm or less. Therefore, in the invention, the maximum size of the long side of the A type inclusion is limited to be 250 μm or less.

Number of A type Inclusions: Number of A Type Inclusions Having Size of Long Side of 1 μm or More and 250 μm or Less is Less Than 25 Per Observed Area of 1 $mm^2$ in Cross-section in Longitudinal Direction of Rail Head When the number of A type inclusions, each having a size of a long side of 1 μm to 250 μm, is 25 or more per observed area of 1 $mm^2$, A type inclusions being rough and large are increased, causing significant degradation in delayed fracture properties of a rail. Therefore, the number of A type inclusions, each having the size of the long side of 1 μm to 250 μm, is adjusted to be less than 25 per observed area of 1 $mm^2$ in a cross-section in a longitudinal direction of a rail head. Preferably, the number is less than 20 per observed area of 1 $mm^2$, and more preferably, less than 6 per observed area of 1 $mm^2$. When size of an A type inclusion in a rail is less than 1 μm, the A type inclusion is sphered, therefore even if the inclusion exists in steel, the delayed fracture properties are not degraded. In the invention, the number of A type inclusions having the size of 1 μm to 250 μm was specified.

Next, a figure of a C type inclusion and the quantity of C type inclusions are importantly controlled in at least a head of a rail. Here, the C type inclusions correspond to those defined in Appendix 1 of JIS G0555, which is used for evaluating the quantity of C type inclusions and the figure of a C type inclusion in the invention.

Size of C Type Inclusion: Size of Long Side is 50 μm Less in Cross-section in Longitudinal Direction of Rail Head First, since a C type inclusion having a size of a long side of more than 50 μm significantly reduces RCF resistance of a rail, the size of the long side of the C type inclusion needs to be limited to be 50 μm or less. Here, meaning of the description that size of the long side of the C type inclusion is limited to be 50 μm or less is that when C type inclusions are observed in a view field of 50 $mm^2$ with a magnification of 500 by an optical microscope so as to measure size of each long side of all the found C type inclusions, each inclusion having a size of a long side of 0.5 μm or more, the maximum size of the long side is 50 μm or less.

Figure 10:
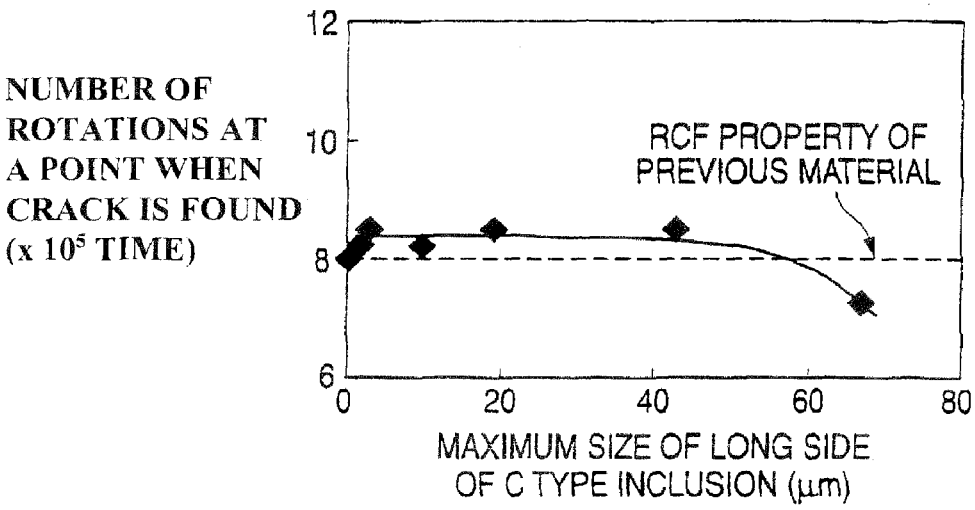
FIG. 10 shows a graph showing an effect of maximum size of a long side of a C type inclusion on RCF resistance in the materials of the invention and the comparative materials.

Here, in another example as described later, a relationship between size of a long side of each C type inclusion and each of improved values of RCF properties is shown in FIG. 10 in an arranged manner. As shown in the figure, RCF properties of a rail can be secured at least the same level as in a conventional material in the case that the maximum size of the long side of the C type inclusion is 50 μm or less. Therefore, in the invention, the maximum size of the long side of the C type inclusion is limited to be 50 μm or less.

Figure 11A:
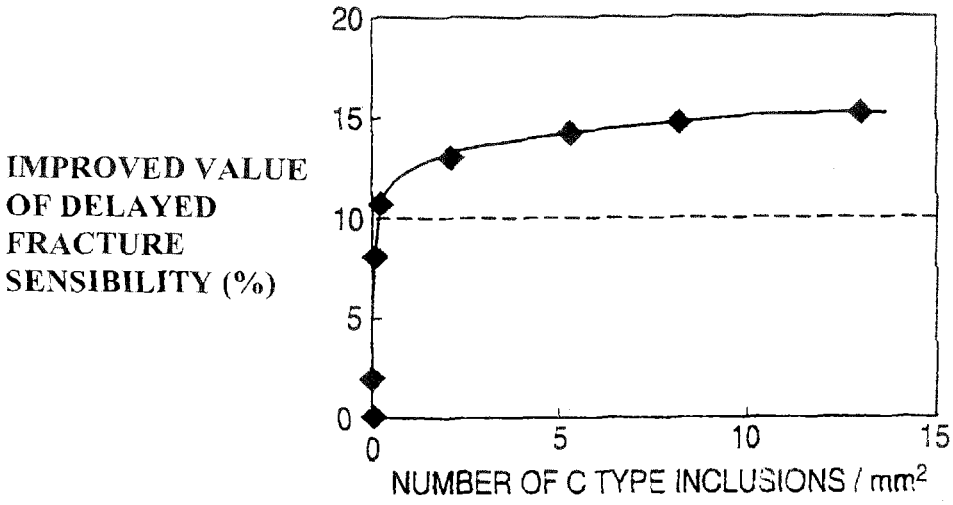
FIG. 11A shows a graph showing an effect of the number of the C type inclusions on an improved value of delayed fracture sensibility in the materials of the invention and the comparative materials.

Number of C Type Inclusions: Number of Inclusions Having Size of Long Side of 1 μm or More and 50 μm or Less is 0.2 or More and 10 or Less Per Observed Area of 1 $mm^2$ in Cross-section in Longitudinal Direction of Rail Head Furthermore, the number of C type inclusions, each having a size of the long side of 1 μm to 50 μm, is controlled to be 0.2 to 10 per observed area of 1 $mm^2$ in a cross-section in a longitudinal direction of a rail head. That is, since a C type inclusion having a size of the long side of less than 1 μm is sphered, the C type inclusion does not have any effect on delayed fracture properties. Conversely, a C type inclusion having a size of the long side of 1 μm or more contributes to delayed fracture properties. Such a C type inclusion having the size of the long side of 1 μm or more, which contributes to improving delayed fracture properties, needs to be controlled to exist by at least 0.2 per observed area of 1 $mm^2$. Here, in still another example as described later, a relationship between the number of C type inclusions, each having a size of a long side of 1 μm or more, and an improved value of delayed fracture sensibility is shown in FIG. 11A in an arranged manner. As shown in the figure, such an improved value is 10% or more in the case that the number is at least 0.2 per observed area of 1 $mm^2$ (refer to FIG. 11A). When the number of C type inclusions exceeds 10, RCF resistance is reduced. Therefore, the number is limited to be 10 or less (refer to FIG. 11B). Here, the maximum size of the long side of the C type inclusion, and the number of C type inclusions having the size of the long side of 1 μm to 50 μm are obtained through a measurement in which C type inclusions are observed in a view field of 50 $mm^2$ with a magnification of 500 by an optical microscope to measure size of a long side of any of the found C type inclusions.

Next, a method of manufacturing a pearlitic steel rail of the invention is described.

In manufacturing the rail of the invention, steel is produced by a steel converter or an electric heating furnace, then a composition of the steel is adjusted into the above range through secondary refining such as degasification as needed, and then the steel is formed into a bloom by, for example, continuous casting. The bloom immediately after the continuous casting is essentially loaded into a slow cooling box in which the bloom is subjected to cooling over 40 to 150 hours at a cooling rate of 0.5° C./s or less. The amount of hydrogen in steel can be adjusted to be 2 ppm or less through the slow cooling.

Next, the bloom after the cooling is heated to 1200 to 1350° C. in a heating furnace, and then hot-rolled into a rail. The hot rolling is preferably performed at a finish rolling temperature of 900 to 1000° C., and cooling after rolling is preferably performed at a cooling rate of 1° C./s or more and 5° C./s or less.

Next, a method of measuring each of size of a long side of each of the A type inclusion and the C type inclusion, the number of each of the inclusions having the specified size, and amount of hydrogen in steel, to be specified in the invention, and a method of evaluating each of RCF resistance and delayed fracture properties are described.

Dimensional Measurement and Number Measurement of A Type Inclusions:

Defining that a position is a start point, which is situated at a depth of 12.7 mm from a surface of a rail head, and 5 mm distant from the center in a rail width direction, a sample is taken as a test piece for microscope observation, of which the cross-section in 12.7 mm*19.1 mm along a longitudinal direction of a rail is defined as an observation surface as shown in FIG. 1, and an observed surface is subjected to mirror finish. Over a region of 5 mm*10 mm (observed area of 50 $mm^2$) in a central portion of the test piece, sulfide nonmetallic inclusions are observed with no-etching with magnifying power of a microscope of 500 so as to measure size of each long side of all the found A type inclusions. Moreover, maximum size of the long side of the A type inclusion is obtained in the same observed area. Moreover, the number of A type inclusions having a size of a long side of 1 μm to 250 μm is measured. The number is converted into a number of A type inclusions per square millimeters.

Dimensional Measurement and Number Measurement of C Type Inclusions:

Defining that a position is a start point, which is situated at a depth of 12.7 mm from a surface of a rail head, and 5 mm distant from the center in a rail width direction, a sample is taken as a test piece for microscope observation, of which the cross-section in 12.7 mm*19.1 mm along a longitudinal direction of a rail is defined as an observation surface as shown in FIG. 1, and an observed surface is subjected to mirror finish. Over a region of 5 mm*10 mm (observed area of 50 $mm^2$) in a central portion of the test piece, C type inclusions are observed with no-etching with magnifying power of a microscope of 500 so as to measure size of each long side of all the found C type inclusions. The size of the long side is defined as length of the C type inclusion. Moreover, maximum size of the long side of the C type inclusion is obtained in the same observed area. Moreover, the number of C type inclusions having a size of a long side of 1 μm to 50 μm is measured, and then the number is converted into a number per square millimeters.

Measurement of the Amount of Hydrogen in Steel

Figure 2:
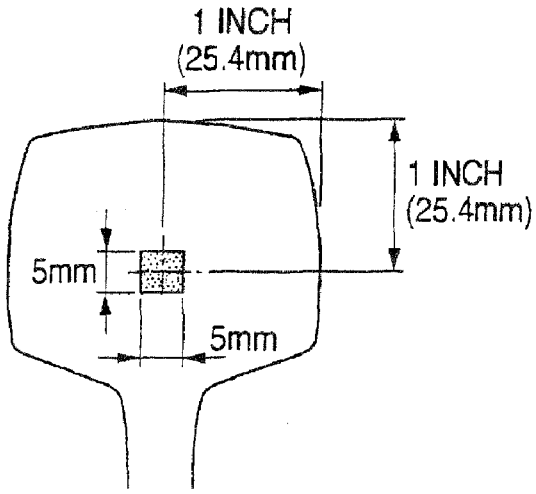
FIG. 2 shows a diagram showing a collection position of a sample used for measuring the amount of hydrogen in steel.

Defining that a position is the center (FIG. 2), which is situated at a depth of 25.4 mm from a surface of a rail head, and 25.4 mm distant from aside of the head, a test piece having a section area of 5 mm*5 mm and a length of 100 mm is taken along a longitudinal direction of the rail head, and then the amount of hydrogen in steel is measured according to the inert gas fusion method-heat transfer method (JIS Z 2614).

Delayed Fracture Test

Figure 3:
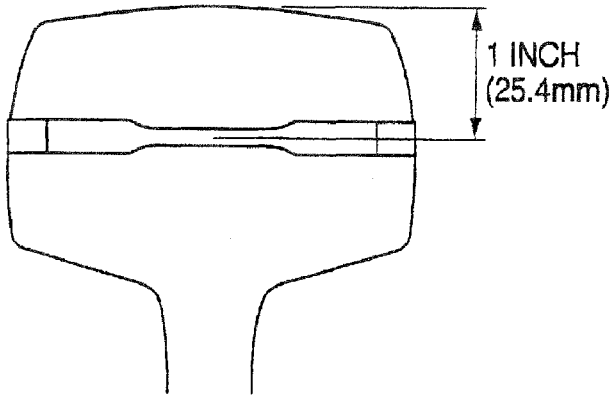
FIG. 3 shows a diagram showing a collection position of an SSRT (Slow Strain Rate technique) test piece.
Figure 4:
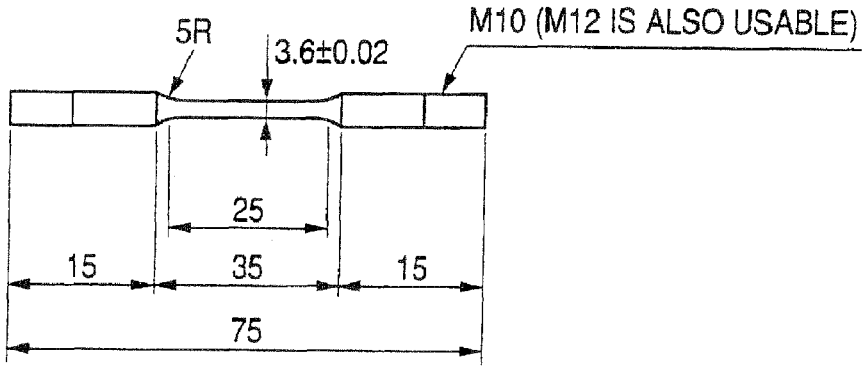
FIG. 4 shows a diagram showing a shape and dimensions of the test piece used for the SSRT test.

Defining that a position at a depth of 25.4 mm from a surface of a rail head is the center (FIG. 3), a test piece having dimensions as shown in FIG. 4 is taken. The test piece is subjected to three triangle mark finish except for screw sections and round sections, and a parallel body is emery-papered to #600. The test niece is mounted on an SSRT (Slow Strain Rate Technique) test apparatus, and then subjected to an SSRT test at a strain rate of $3.3*10^{-6}$/s at 25° C. in the air, so that elongation $E_0$ of the test piece in the air is obtained. Similarly as the test of elongation $E_0$ in the air, the test piece is mounted on the SSRT test apparatus, than subjected to the SSRT test at a strain rate of $3.3*10^{-6}$/s in 20% ammonium thiocyanate ($NH_4SCN$) solution 25° C., so that elongation $E_1$ in an aqueous solution is obtained. Delayed fracture sensibility (DF) to be an index for evaluating delayed fracture properties is calculated by substituting values of $E_0$ and $E_1$, which are obtained by measurements in the above way, into the formula: $DF=100*(1-E_1/E_0)$. In evaluation of the delayed fracture properties, delayed fracture properties of currently used, heat treatment type pearlitic steel having the C content of 0.68% is defined as a standard, and when an improved value of delayed fracture sensibility is increased by 10% therefrom, the delayed fracture properties are determined to be improved.

Tensile Test

Figure 5:
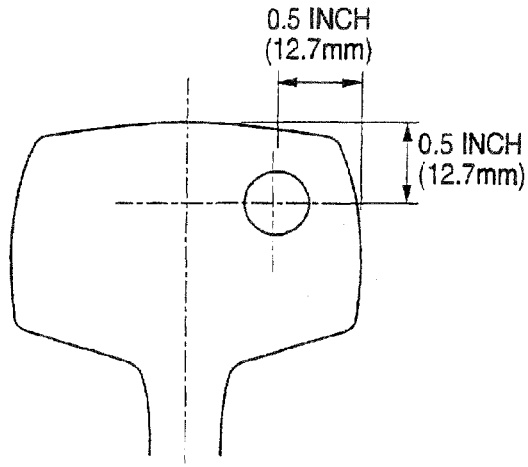
FIG. 5 shows a diagram showing a collection position of a tensile test piece.

Defining that a position was a position of a central axis, which was situated at a depth of 12.7 mm from a surface of a rail head, and 12.7 mm distant from a side of the head (FIG. 5), a round test bar having a diameter of 12.7 mm (0.5 inch) as described in ASTM E8-04 was taken, and then subjected to a tensile test with gauge length of 25.4 mm (1 inch).

RCF Resistance Test

Figure 8:
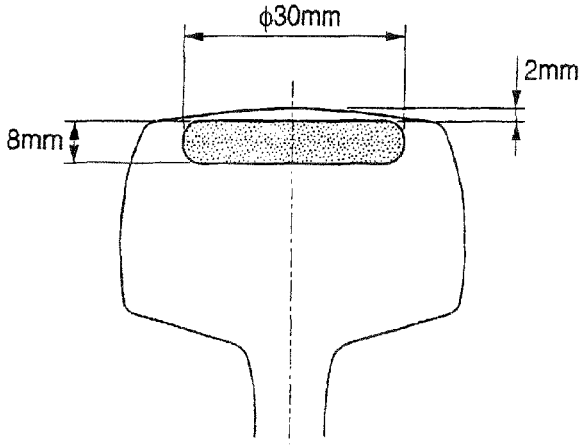
FIG. 8 shows a diagram showing a collection position of a sample used for an RCF test.
Figure 9:
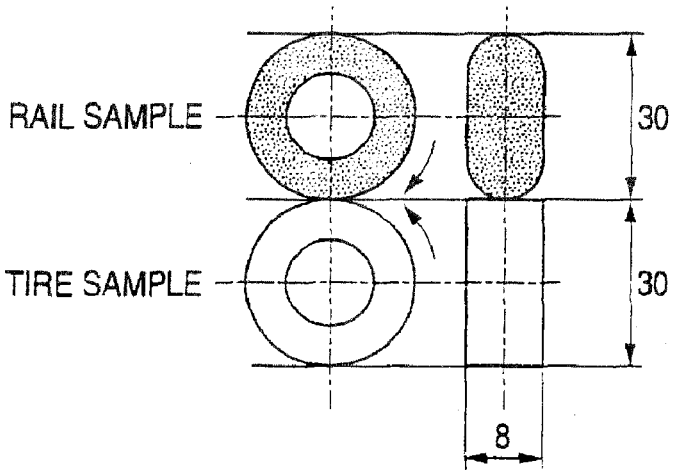
FIG. 9 shows a diagram showing a shape of a sample used for the RCF test.

RCF resistance was evaluated by simulating an actual condition of rail and wheel contact using a Nishihara type rolling contact test machine. Regarding the RCF resistance, defining that a position at a depth of 2 mm from a surface of a rail head is a start point (FIG. 8), a Nishihara type rolling contact test piece having a diameter of 30 mm (FIG. 9) was taken, of which the contact face was formed to be a curved surface having a curvature radius of 15 mm, and the test piece was subjected to a rolling contact test at a condition of contact pressure of 2.2 GPa, slip ratio of −20%, and oil lubrication. Then, a surface of the test piece was observed every 25,000 rolling contacts, and a number of rotations at a point when a crack of 0.5 mm or more was found was defined as an RCF life.

Hereinafter, examples of the invention are specifically described.

EXAMPLES

Example 1

Steel Nos. 1-1 to 1-7 having chemical compositions shown in Table 1 was heated to 1250° C., then subjected to hot rolling which was finished at 900° C., and then cooled at a cooling rate of 2° C./s, so that rails Nos. 1-1 to 1-7 were manufactured. The rails Nos. 1-1 to 1-7 were measured in maximum size of a long side of an A type inclusion, number of A type inclusions having a size of a long side of 1 to 250 μm, and amount of hydrogen in steel, and furthermore the rails were evaluated in tensile strength, delayed fracture sensibility, and improved value of delayed fracture sensibility according to the method described above. In evaluation of the improved value of delayed fracture sensibility, defining that delayed fracture sensibility of the rail No. 1-1 manufactured by using the steel No. 1-1, which was currently used, heat treatment type pearlitic steel having the C content of 0.68%, was a standard, when the delayed fracture sensibility was improved by 10% or more compared with the rail No 1-1, the delayed fracture properties were determined to be improved. For example, an improved value of delayed fracture sensibility of the steel No. 1-2 is obtained as (85.0-84.2)/85.0*100=0.9%. The rail No. 1-1 was manufactured by using the steel No. 1-1, and the rail No. 1-2 was manufactured by using the steel No. 1-2. Similarly, the rails Nos. 1-3 to 1-7 were manufactured by using steel corresponding to the steel Nos. 1-3 to 1-7 respectively.

Figure 6:
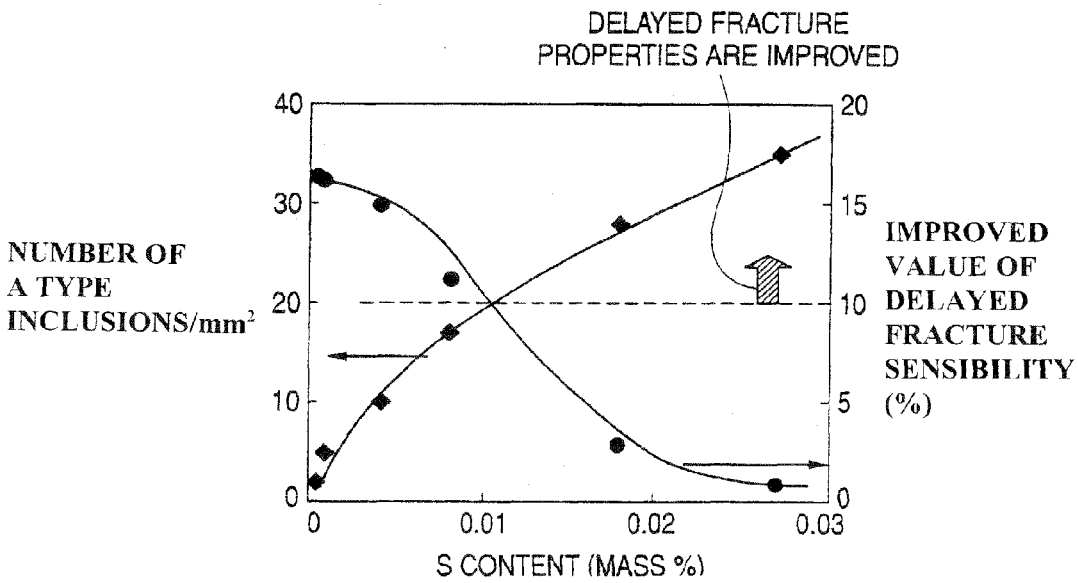
FIG. 6 shows a graph showing an effect of the S content on the number of A type inclusions and on an improved value of delayed fracture sensibility in materials of the invention and comparative materials.

Results of the tests are described in Table 2. FIG. 6 shows a graph showing a relationship between the S content plotted in abscissa, and the number of A type inclusions having a size of a long side of 1 to 250 μm and an improved value of delayed fracture sensibility plotted in ordinate, which shows increase or decrease in number of the A type inclusions having the size of the long side of 1 to 250 μm, and shows increase or decrease in delayed fracture sensibility compared with delayed fracture sensibility of the rail No. 1-1 being a conventional material. Furthermore, FIG. 7 shows a graph showing a relationship between the S content plotted in abscissa, and the maximum size of a long side of an A type inclusion and an improved value of delayed, fracture sensibility plotted in ordinate, which shows increase or decrease in maximum size of the long side of the A type inclusion, and shows increase or decrease in delayed fracture sensibility compared with delayed fracture sensibility of the rail No. 1-1 being the conventional material.

As shown in FIGS. 6 and 7, it was known that the number of the A type inclusions having the size of the long side of 1 to 250 μm was adjusted to be less than 20 per 1 $mm^2$ of observed area, and the maximum size of the long side of the A type inclusion was adjusted to be 250 μm or less, thereby each of the rails Nos. 1-4 to 1-7 being materials of the invention was improved by 10% or more in improved value of delayed fracture sensibility compared with the rail No. 1-1 being the conventional material. Accordingly, it was confirmed that each of the rails Nos. 1-4 to 1-7 being the materials of the invention had high tensile strength of 1200 MPa or more, in addition, had excellent delayed fracture properties as shown in Table 2.

Example 2

Steel Nos. 2-1 to 2-15 having chemical compositions shown in Table 3 were heated to 1250° C., then subjected to hot rolling which was finished at 900° C., and then cooled at a cooling rate of 2° C./s, so that rails Nos. 2-1 to 2-15 were manufactured. The rails Nos. 2-1 to 2-15 were measured in maximum size of a long side of an A type inclusion, number of A type inclusions having a size of a long side of 1 to 250 μm, and amount of hydrogen in steel, and furthermore the rails were evaluated in delayed fracture sensibility, and improved value of delayed fracture sensibility, as on the example 1. In evaluation of the improved value of delayed fracture sensibility, defining that delayed fracture sensibility of the rail No. 2-1 manufactured by using the steel No. 2-1, which was currently used, heat treatment type pearlitic steel having the C content of 0.68%, was a standard, when an improved value of delayed fracture sensibility was increased by 10% or more compared with the rail No. 2-1, the delayed fracture properties were determined to be improved. The rail No 2-1 was manufactured by using the steel No. 2-1, and the rail No. 2-2 was manufactured by using the steel No. 2-2. Similarly, the rails Nos. 2-3 to 2-15 were manufactured by using steel corresponding to the steel Nos. 2-3 to 2-15 respectively.

Results of the tests are described in Table 4. From the results, it was known that in the rails Nos. 2-7 to 2-13 being materials of the invention, a composition of C, Si, Mn, P and S was controlled to be in an appropriate range, and one or at least two components selected from V, Cr, Cu, Ni, Nb, Mo and W were contained in an appropriate range, in addition, maximum size of a long side of an A type inclusion, and the number of A type inclusions having a size of a long side of 1 to 250 μm, and the amount of hydrogen in steel, and the content of each of Al and Ti being impurities were adjusted to be in an appropriate range respectively, thereby delayed fracture properties of a rail was able to be improved compared with the rails Nos. 2-2 to 2-6, 2-14, and 2-15 being comparative examples. Accordingly, it was confirmed that each of the rails Nos. 2-7 to 2-13 being the material of the invention had which tensile strength of 1200 MPa or more, in addition, had excellent delayed fracture properties as shown in Table 4.

Example 3

Blooms were produced by continuous casting from ingots prepared in compositions as shown in Table 5, and the blooms immediately after the continuous casting were kept for 40 to 150 hours in a slow cooling box so as to be slowly cooled. Then, the blooms were heated to 1250° C., and then subjected to hot rolling with a finish temperature of 900° C., and then cooled at 2° C./s so that pearlitic steel rails were manufactured. The rails obtained in this way were measured in quantity of inclusions and amount of hydrogen in steel, and evaluated in tensile strength, delayed fracture properties, and RCA resistance. Results of the measurements and evaluations are shown in Table 6.

Figure 11B:
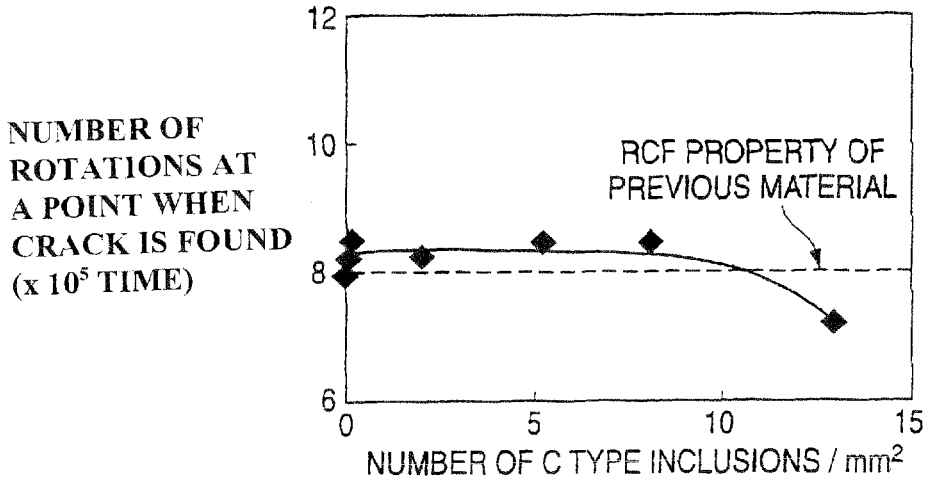
FIG. 11B shows a graph showing an effect of the number of the C type inclusions on RCF resistance in the materials of the invention and the comparative materials.

As shown in Table 6, in each of rails A-4 to A-7 according to the invention, compared with a rail A-3 of a comparative example, a composition of C, Si, Mn, S, Ca and O is controlled to be in an appropriate range, in addition, maximum size of a long side of a C type inclusion, and the number of C type inclusions having a size of a long side of 1 to 50 μm are adjusted to be in a certain range respectively, thereby delayed fracture properties can be improved without reducing RCA resistance of a rail (FIG. 10, and FIGS. 11A and 11B). While A-1, A-2 and A-8 show examples of the invention respectively, since they are departed from a preferable range of the invention in number of the C type inclusions having the size of the long side of 1 to 50 μm, maximum size of the long side of the C type inclusion, or the expression (1), they are bad in delayed fracture properties compared with the materials of the invention A-4 to A-7.

Example 4

Blooms were produced by continuous casting from ingots prepared in compositions as shown in Table 7, and the blooms immediately after the continuous casting were subjected to cooling at a condition as shown in Table 8. Then, the blooms were heated to 1250° C., and then subjected to hot rolling with a finish temperature of 900° C., and then cooled at 2° C./s so that rails were manufactured. The rails obtained in this way were measured in quantity of inclusions, and amount of hydrogen in steel, and evaluated in tensile strength, delayed fracture properties, and RCA resistance according to the above. Results of the measurements and evaluations are shown in Table 8.

As shown in Table B, in each of rails B-8 to B-14 and B-16 according to the invention, compared with rails B-2 to B-7 of comparative examples, a composition of C, Si, Mn, S, Ca and O is controlled to be in an appropriate range, and one or at least two components selected from V, Cr, Nb, Cu, Ni, Mo and W are contained in an appropriate range, in addition, maximum size of a long side of a C type inclusion, and the number of C type inclusions having a size of a long side of 1 to 50 μm are adjusted to be in a certain range respectively, thereby delayed fracture properties can be improved without reducing RCA resistance of a rail. B-15 shows an inventive example having a high amount of hydrogen in steel compared with B-16. As seen in B-15, when the amount of hydrogen in steel is out of a certain range (more than 2 ppm) despite a material of the invention, delayed fracture properties are degraded. Therefore, the amount of hydrogen in steel is adjusted to be in the certain range, thereby the delayed fracture properties can be specifically improved. Moreover, when the content of each of Al and Ti being impurities is out of an appropriate range as in B-17 or B-18, delayed fracture properties and RCA resistance are degraded. Therefore, the content of each of Al and Ti is adjusted to be in the certain range, thereby the delayed fracture properties can be improved without reducing the RCA resistance. While B-1 shows an example of the invention, since it is departed from a preferable range of the invention in number of the C type inclusions having the size of the long side of 1 to 50 μm, maximum size of the long side of the C type inclusion, or the expression (1), it is bad in delayed fracture properties compared with the materials of the invention B-8 to B-16.

The invention provides an excellent rail that contributes to prolongation of rail life of a high-axle load railway or prevention of railway accidents, whereby industrially beneficial advantages are given.

TABLE 1

(mass percent)

| Steel No. | C | Si | Mn | P | S | Al | Ti | Remarks |
|---|---|---|---|---|---|---|---|---|
| 1-1 | 0.68 | 0.19 | 1.02 | 0.012 | 0.012 | 0.0010 | 0.0010 | conventional material |
| 1-2 | 0.85 | 0.52 | 1.17 | 0.014 | 0.027 | 0.0010 | 0.0005 | comparative material |
| 1-3 | 0.81 | 0.55 | 1.22 | 0.011 | 0.018 | 0.0010 | 0.0005 | comparative material |
| 1-4 | 0.83 | 0.52 | 1.11 | 0.015 | 0.008 | 0.0005 | 0.0010 | material of the invention |
| 1-5 | 0.89 | 0.49 | 1.10 | 0.014 | 0.004 | 0.0010 | 0.0010 | material of the invention |
| 1-6 | 0.79 | 0.59 | 1.19 | 0.015 | 0.001 | 0.0005 | 0.0005 | material of the invention |
| 1-7 | 0.79 | 0.61 | 1.15 | 0.011 | 0.0005 | 0.0010 | 0.0010 | material of the invention |

TABLE 2

| Steel No. | Tensile strength (MPa) | Elongation (%) | Number of A type inclusions/ $mm^2$ | Maximum size of long side of A type inclusion (μm) | Amount of hydrogen in steel (ppm by weight) | Delayed fracture sensibility (%) | Improved value of delayed fracture sensibility (%) | Remarks |
|---|---|---|---|---|---|---|---|---|
| 1-1 | 1215 | 14.5 | 26 | 277 | 1.6 | 85.0 | 0.0 | conventional material |
| 1-2 | 1301 | 12.3 | 35 | 381 | 1.5 | 84.2 | 0.9 | comparative material |
| 1-3 | 1287 | 11.5 | 28 | 311 | 1.8 | 82.5 | 2.9 | comparative material |
| 1-4 | 1299 | 12.1 | 17 | 235 | 1.4 | 75.5 | 11.2 | material of the invention |
| 1-5 | 1321 | 10.9 | 10 | 95 | 1.5 | 72.2 | 15.1 | material of the invention |
| 1-6 | 1268 | 13.3 | 5 | 41 | 1.6 | 71.1 | 16.4 | material of the invention |
| 1-7 | 1253 | 13.3 | 2 | 5 | 1.6 | 71 | 16.5 | material of the invention |

TABLE 3

(mass percent)

| Steel No | C | Si | Mn | P | S | V | Cr | Cu | Ni | Nb | Mo | W | Al | Ti | Remarks |
|---|---|---|---|---|---|---|---|---|---|---|---|---|---|---|---|
| 2-1 | 0.68 | 0.19 | 1.02 | 0.012 | 0.012 | — | 0.15 | — | — | — | — | — | 0.0010 | 0.0010 | Reference materiia |
| 2-2 | 0.73 | 0.42 | 1.21 | 0.011 | 0.027 | — | 0.32 | — | — | 0.02 | — | — | 0.0010 | 0.0005 | Comparative material |
| 2-3 | 0.55 | 0.32 | 0.99 | 0.014 | 0.005 | — | — | — | — | — | — | — | 0.0005 | 0.0005 | Comparative material |
| 2-4 | 1.15 | 0.51 | 0.88 | 0.015 | 0.008 | — | — | — | — | 0.01 | — | — | 0.0010 | 0.0010 | Comparative material |
| 2-5 | 0.81 | 1.51 | 0.79 | 0.011 | 0.006 | — | — | — | — | — | — | — | 0.0005 | 0.0010 | Comparative material |
| 2-6 | 0.89 | 0.61 | 1.73 | 0.015 | 0.007 | — | 0.21 | — | — | — | — | — | 0.0010 | 0.0010 | Comparative material |
| 2-7 | 0.91 | 0.51 | 1.05 | 0.014 | 0.004 | — | 0.25 | — | — | 0.01 | — | — | 0.0005 | 0.0010 | Material of the invention |
| 2-8 | 0.80 | 0.55 | 1.19 | 0.011 | 0.001 | — | — | 0.12 | 0.25 | 0.03 | — | — | 0.0005 | 0.0010 | Material of the invention |
| 2-9 | 0.83 | 0.21 | 1.09 | 0.015 | 0.008 | — | — | — | — | — | 0.10 | — | 0.0010 | 0.0010 | Material of the invention |
| 2-10 | 0.64 | 0.91 | 0.64 | 0.011 | 0.005 | 0.04 | — | — | — | — | — | 0.21 | 0.0010 | 0.0005 | Material of the invention |
| 2-11 | 0.77 | 0.81 | 0.75 | 0.016 | 0.003 | — | 0.60 | — | — | 0.01 | — | 0.75 | 0.0010 | 0.0005 | Material of the invention |
| 2-12 | 0.89 | 0.45 | 1.21 | 0.015 | 0.001 | 0.01 | 0.11 | — | — | — | 0.30 | 0.11 | 0.0005 | 0.0010 | Material of the invention |
| 2-13 | 0.79 | 0.51 | 0.70 | 0.011 | 0.002 | — | — | — | — | 0.03 | 0.51 | — | 0.0005 | 0.0010 | Material of the invention |
| 2-14 | 0.81 | 0.92 | 0.81 | 0.009 | 0.008 | — | — | — | — | 0.03 | 0.09 | — | 0.0025 | 0.0005 | Comparative material |
| 2-15 | 0.83 | 0.83 | 0.92 | 0.015 | 0.007 | — | 0.15 | — | — | 0.04 | — | — | 0.0010 | 0.0022 | Comparative material |

TABLE 4

| Steel No. | Tensile strength (MPa) | Elongation (%) | Number of A type inclusions/ $mm^2$ | Maximum size of long side of A type inclusion (μm) | Amount of hydrogen in steel (ppm by weight) | Delayed fracture sensibility (%) | Improved value of delayed fracture sensibility (%) | Remarks |
|---|---|---|---|---|---|---|---|---|
| 2-1 | 1215 | 14.5 | 26 | 277 | 1.6 | 85.0 | 0.0 | Reference materila |
| 2-2 | 1261 | 13.3 | 34 | 392 | 1.5 | 84.2 | 0.9 | Comparative material |
| 2-3 | 1102 | 15.9 | 11 | 100 | 1.2 | 75.2 | 11.5 | Comparative material |
| 2-4 | 1351 | 12.3 | 19 | 121 | 1.5 | 79.7 | 6.2 | Comparative material |
| 2-5 | 1299 | 13.1 | 16 | 109 | 1.4 | 78.8 | 7.3 | Comparative material |
| 2-6 | 1346 | 12.5 | 17 | 116 | 1.0 | 78.4 | 7.8 | Comparative material |
| 2-7 | 1316 | 12.8 | 13 | 101 | 1.2 | 72.3 | 14.9 | Material of the invention |
| 2-8 | 1250 | 13.1 | 4 | 29 | 1.5 | 71.5 | 15.9 | Material of the invention |
| 2-9 | 1299 | 12.9 | 19 | 215 | 1.4 | 75.4 | 11.3 | Material of the invention |
| 2-10 | 1210 | 14.1 | 12 | 99 | 1.0 | 75.1 | 11.6 | Material of the invention |
| 2-11 | 1271 | 13.9 | 11 | 68 | 0.9 | 74.1 | 12.8 | Material of the invention |
| 2-12 | 1301 | 12.8 | 2 | 35 | 1.6 | 71.3 | 16.1 | Material of the invention |
| 2-13 | 1315 | 10.4 | 5 | 42 | 0.2 | 70.1 | 17.5 | Material of the invention |
| 2-14 | 1301 | 10.2 | 17 | 199 | 1.1 | 76.9 | 9.5 | Comparative material |
| 2-15 | 1315 | 11.3 | 16 | 187 | 0.9 | 77.2 | 9.2 | Comparative material |

TABLE 5

(mass percent)

| Rail No. | C | Si | Mn | P | S | Ca | O | Al | Ti | Value of Expression (1) | Remarks |
|---|---|---|---|---|---|---|---|---|---|---|---|
| A-1 | 0.67 | 0.27 | 1.18 | 0.015 | 0.009 | 0.0004 | 0.0017 | 0.0005 | 0.0005 | 0.00 | Material of the invention |
| A-2 | 0.85 | 0.27 | 1.15 | 0.015 | 0.009 | 0.0005 | 0.0015 | 0.0005 | 0.0005 | 0.01 | Material of the invention |
| A-3 | 0.79 | 0.33 | 1.08 | 0.011 | 0.006 | 0.0150 | 0.0011 | 0.0010 | 0.0005 | 1.69 | Comparative material |
| A-4 | 0.81 | 0.31 | 1.21 | 0.011 | 0.006 | 0.0013 | 0.0020 | 0.0010 | 0.0010 | 0.08 | Material of the invention |
| A-5 | 0.88 | 0.32 | 1.01 | 0.013 | 0.005 | 0.0025 | 0.0018 | 0.0005 | 0.0010 | 0.25 | Material of the invention |
| A-6 | 0.79 | 0.35 | 1.01 | 0.010 | 0.004 | 0.0054 | 0.0011 | 0.0005 | 0.0010 | 0.89 | Material of the invention |
| A-7 | 0.83 | 0.41 | 1.12 | 0.012 | 0.005 | 0.0086 | 0.0012 | 0.0010 | 0.0005 | 1.13 | Material of the invention |
| A-8 | 0.77 | 0.39 | 1.15 | 0.011 | 0.005 | 0.0006 | 0.0010 | 0.0010 | 0.0010 | 0.05 | Material of the invention |

TABLE 6

| Rail No. | Tensile strength (MPa) | Elongation (%) | Number of C type inclusions/ $mm^2$ | Maximum size of long side of C type inclusion (μm) | Amount of hydrogen in steel (ppm by weight) | Delayed fracture sensibility (%) | Improved value of delayed fracture sensibility (%) | Number of rotations at point when crack is found ($*10^5$) | Remarks |
|---|---|---|---|---|---|---|---|---|---|
| A-1 | 1221 | 14.3 | 0 | 0.5 | 1.4 | 76.5 | 10.0 | 8.00 | Material of the invention |
| A-2 | 1321 | 10.8 | 0 | 0.5 | 1.3 | 75.1 | 11.6 | 8.25 | Material of the invention |

TABLE 6-continued

| Rail No. | Tensile strength (MPa) | Elongation (%) | Number of C type inclusions/ $mm^2$ | Maximum size of long side of C type inclusion (μm) | Amount of hydrogen in steel (ppm by weight) | Delayed fracture sensibility (%) | Improved value of delayed fracture sensibility (%) | Number of rotations at point when crack is found (*$10^5$) | Remarks |
|---|---|---|---|---|---|---|---|---|---|
| A-3 | 1254 | 11.5 | 13 | 67 | 0.9 | 64.8 | 23.8 | 7.25 | Comparative material |
| A-4 | 1237 | 11.3 | 0.2 | 3 | 1.0 | 68.3 | 19.6 | 8.50 | Material of the invention |
| A-5 | 1310 | 10.9 | 2.1 | 10 | 1.7 | 66.6 | 21.6 | 8.25 | Material of the invention |
| A-6 | 1299 | 11.0 | 5.3 | 19 | 0.7 | 65.6 | 22.8 | 8.50 | Material of the invention |
| A-7 | 1254 | 11.8 | 8.2 | 43 | 1.3 | 65.1 | 23.4 | 8.50 | Material of the invention |
| A-8 | 1235 | 12.1 | 0.1 | 2 | 1.0 | 70.3 | 17.3 | 8.25 | Material of the invention |

TABLE 7

(mass percent)

| Rail No. | C | Si | Mn | P | S | Ca | O | V | Cr | Cu | Ni | Nb | Mo | W | Al | Ti | Value of Ex-pres-sion | Remarks |
|---|---|---|---|---|---|---|---|---|---|---|---|---|---|---|---|---|---|---|
| B-1 | 0.67 | 0.27 | 1.18 | 0.015 | 0.009 | 0.0004 | 0.0017 | — | — | — | — | — | — | — | 0.0005 | 0.0005 | 0.00 | Material of the invention |
| B-2 | 0.71 | 0.41 | 1.21 | 0.015 | 0.026 | 0.0012 | 0.0018 | — | 0.31 | — | — | 0.03 | — | — | 0.0010 | 0.0010 | 0.02 | Com-parative material |
| B-3 | 0.51 | 0.33 | 1.00 | 0.013 | 0.014 | 0.0021 | 0.0014 | — | — | — | — | — | — | — | 0.0010 | 0.0010 | 0.29 | Com-parative material |
| B-4 | 1.16 | 0.51 | 0.89 | 0.014 | 0.007 | 0.0042 | 0.0014 | — | — | — | — | 0.02 | 0.01 | — | 0.0010 | 0.0005 | 0.36 | Com-parative material |
| B-5 | 0.77 | 1.52 | 0.69 | 0.013 | 0.006 | 0.0038 | 0.0015 | — | — | — | — | — | — | — | 0.0010 | 0.0005 | 0.37 | Com-parative material |
| B-6 | 0.71 | 0.63 | 2.42 | 0.014 | 0.007 | 0.0024 | 0.0014 | — | 0.11 | — | — | — | — | — | 0.0005 | 0.0005 | 0.20 | Com-parative material |
| B-7 | 0.81 | 0.31 | 0.99 | 0.011 | 0.004 | 0.0091 | 0.0041 | 0.03 | — | — | — | — | — | — | 0.0010 | 0.0010 | 0.76 | Com-parative material |
| B-8 | 0.89 | 0.44 | 1.01 | 0.013 | 0.003 | 0.0031 | 0.0018 | — | 0.25 | — | — | — | 0.05 | — | 0.0010 | 0.0010 | 0.55 | Material of the invention |
| B-9 | 0.79 | 0.88 | 0.51 | 0.012 | 0.001 | 0.0019 | 0.0017 | — | — | 0.12 | 0.22 | 0.01 | — | — | 0.0005 | 0.0010 | 0.94 | Material of the invention |
| B-10 | 0.81 | 0.31 | 1.15 | 0.011 | 0.008 | 0.0091 | 0.0016 | — | — | — | — | — | 0.15 | — | 0.0005 | 0.0010 | 0.69 | Material of the invention |
| B-11 | 0.64 | 0.81 | 1.79 | 0.009 | 0.004 | 0.0021 | 0.0014 | 0.02 | — | — | — | — | — | 0.18 | 0.0010 | 0.0010 | 0.29 | Material of the invention |
| B-12 | 0.74 | 0.78 | 1.01 | 0.013 | 0.001 | 0.0017 | 0.0018 | — | 0.55 | — | — | — | — | 0.61 | 0.0010 | 0.0010 | 0.78 | Material of the invention |
| B-13 | 0.83 | 0.51 | 1.05 | 0.014 | 0.007 | 0.0011 | 0.0014 | 0.01 | 0.23 | — | — | — | 0.30 | 0.28 | 0.0005 | 0.0010 | 0.07 | Material of the invention |
| B-14 | 0.81 | 0.35 | 0.95 | 0.015 | 0.008 | 0.0011 | 0.0016 | — | — | — | — | 0.02 | 0.48 | — | 0.0010 | 0.0005 | 0.06 | Material of the invention |
| B-15 | 0.91 | 0.41 | 0.99 | 0.010 | 0.004 | 0.0021 | 0.0014 | — | 0.11 | — | — | — | 0.11 | — | 0.0010 | 0.0005 | 0.29 | Material of the invention |
| B-16 | 0.91 | 0.41 | 0.99 | 0.010 | 0.004 | 0.0021 | 0.0014 | — | 0.11 | — | — | — | 0.11 | — | 0.0005 | 0.0005 | 0.29 | Material of the invention |

TABLE 7-continued (mass percent)

| Rail No. | C | Si | Mn | P | S | Ca | O | V | Cr | Cu | Ni | Nb | Mo | W | Al | Ti | Value of Expression | Remarks |
|---|---|---|---|---|---|---|---|---|---|---|---|---|---|---|---|---|---|---|
| B-17 | 0.77 | 0.85 | 0.98 | 0.015 | 0.005 | 0.0011 | 0.0014 | — | 0.33 | — | — | 0.01 | — | — | 0.0031 | 0.0010 | 0.10 | Comparative material |
| B-18 | 0.84 | 0.89 | 0.75 | 0.011 | 0.003 | 0.0019 | 0.0021 | 0.05 | 0.15 | — | — | — | — | — | 0.0005 | 0.0022 | 0.27 | Comparative material |

TABLE 8

| Rail No. | Tensile strength (MPa) | Elongation (%) | Number of C type inclusions/ $mm^2$ | Maximum size of long side of C type inclusion (μm) | Amount of hydrogen in steel (ppm by weight) | Delayed fracture sensibility (%) | Improved value of delayed fracture sensibility (%) | Number of rotations at point when crack is found ($*10^5$) | Remarks |
|---|---|---|---|---|---|---|---|---|---|
| B-1 | 1221 | 14.3 | 0 | 0.5 | 1.4 | 76.5 | 10.0 | 8.25 | Material of the invention |
| B-2 | 1251 | 13.3 | 0 | 0.5 | 1.3 | 77.6 | 8.7 | 8.25 | Comparative material |
| B-3 | 1103 | 15.5 | 3.1 | 12 | 1.5 | 68.8 | 19.1 | 8.00 | Comparative material |
| B-4 | 1290 | 13.3 | 4.0 | 26 | 1.2 | 76.9 | 9.5 | 8.50 | Comparative material |
| B-5 | 1285 | 13.1 | 3.8 | 24 | 1.3 | 77.0 | 9.4 | 8.25 | Comparative material |
| B-6 | 1331 | 11.5 | 2.1 | 18 | 1.1 | 76.9 | 9.5 | 8.25 | Comparative material |
| B-7 | 1291 | 11.8 | 7.8 | 61 | 0.8 | 77.2 | 9.2 | 7.25 | Comparative material |
| B-8 | 1305 | 11.5 | 3.8 | 39 | 1.5 | 68.3 | 19.6 | 8.25 | Material of the invention |
| B-9 | 1299 | 11.5 | 9.2 | 48 | 1.0 | 68.4 | 19.5 | 8.25 | Material of the invention |
| B-10 | 1257 | 12.5 | 7.1 | 38 | 1.3 | 67.9 | 20.1 | 8.25 | Material of the invention |
| B-11 | 1310 | 11.0 | 5.3 | 15 | 0.9 | 68.2 | 19.8 | 8.50 | Material of the invention |
| B-12 | 1266 | 12.1 | 6.5 | 40 | 0.6 | 67.1 | 21.1 | 8.25 | Material of the invention |
| B-13 | 1285 | 11.5 | 0.8 | 6 | 1.6 | 68.1 | 19.9 | 9.25 | Material of the invention |
| B-14 | 1320 | 10.8 | 0.2 | 2 | 0.3 | 68.4 | 19.5 | 10.00 | Material of the invention |
| B-15 | 1350 | 10.5 | 4.1 | 10 | 2.8 | 76.7 | 9.8 | 9.00 | Material of the invention |
| B-16 | 1361 | 10.6 | 4.1 | 10 | 1.3 | 68.2 | 19.8 | 9.00 | Material of the invention |
| B-17 | 1285 | 11.7 | 6.3 | 37 | 0.8 | 77.3 | 9.1 | 7.25 | Comparative material |
| B-18 | 1253 | 12.0 | 5.1 | 14 | 1.1 | 77.8 | 8.5 | 6.50 | Comparative material |

The invention claimed is:

1. A high-strength pearlitic steel rail having a composition consisting of, in mass percent, 0.6% to 1.0% of C, 0.1% to 1.5% of Si, 0.4% to 2.0% of Mn, 0.035% or less of P, 0.0100% or less of S, 0.0010% to 0.010% of Ca, 0.004% or less of O, and the remainder being Fe and inevitable impurities, wherein the tensile strength is 1200 MPa or more, and the size of a long side of a C type inclusion is 50 μm or less in at least a cross-section in a longitudinal direction of a rail head, and the number of C type inclusions, each having a size of a long side of 1 μm to 50 μm, is 0.2 to 10 per observed area of 1 $mm^2$ in the cross-section in the longitudinal direction of the rail head.

2. The high-strength pearlitic steel rail according to claim 1, wherein the mass percent of O in the composition is 0.002% or less.

3. A high-strength pearlitic steel rail having a composition consisting of, in mass percent, 0.6% to 1.0% of C, 0.1% to 1.5% of Si, 0.4% to 2.0% of Mn, 0.035% or less of P, 0.0100% or less of S, 0.0010% to 0.010% of Ca, 0.004% or less of O, one or more elements selected from the group consisting of 0.5% or less of V, 1.5% or less of Cr, 1.0% or less of Cu, 1.0% or less of Ni, 0.05% or less of Nb, 1.0% or less of Mo, and 1.0% or less of W, and the remainder being Fe and inevitable impurities, wherein the tensile strength is 1200 MPa or more, and the size of a long side of a C type inclusion is 50 μm or less in at least a cross-section in a longitudinal direction of a rail head, and the number of C type inclusions, each having a size of a long side of 1 μm to 50 μm, is 0.2 to 10 per observed area of 1 $mm^2$ in the cross-section in the longitudinal direction of the rail head.

4. The high-strength pearlitic steel rail according to claim 3, wherein the mass percent of O in the composition is 0.002% or less.

* * * * *